United States Patent [19]

Krauss et al.

[11] 4,434,566

[45] Mar. 6, 1984

[54] LAUNDRY MANGLE WITH ROLL COVERING REEL

[75] Inventors: Theo Krauss, Aue; Ludwig Herrmann, Bockau; Konrad Berger, Schneeberg, all of German Democratic Rep.

[73] Assignee: VEB Kombinat Textima, Karl-Marx-Stadt, German Democratic Rep.

[21] Appl. No.: 384,320

[22] Filed: Jun. 2, 1982

[30] Foreign Application Priority Data

Aug. 3, 1981 [DD] German Democratic Rep. ..... WPD06F/232327

[51] Int. Cl.[3] ..... D06F 69/02; D06F 67/02

[52] U.S. Cl. ..... 38/8; 38/62

[58] Field of Search ..... 38/1 R, 1 A, 2, 8, 11, 38/51, 52, 53, 100, 44, 56, 62

[56] References Cited

U.S. PATENT DOCUMENTS 972,521 10/1910 Elphick ..... 38/62
3,510,971 5/1970 Bravetti ..... 38/8

FOREIGN PATENT DOCUMENTS 1228223 11/1966 Fed. Rep. of Germany ..... 38/44
7047 of 1904 United Kingdom ..... 38/8

*Primary Examiner*—Werner H. Schroeder
*Assistant Examiner*—Andrew M. Falik
*Attorney, Agent, or Firm*—Jordan and Hamburg

[57] ABSTRACT

A smoothing and drying apparatus comprising at least one mangle cylinder and corresponding trough. Laundry to be smoothed and dried is passed between the mangle cylinder and trough by a guiding belt which is recycled at least one shifting roller placed above the mangle cylinder and trough. Each mangle cylinder has a covering which is wound or unwound around the mangle cylinder by a device situated above the mangle cylinder and below the portions of the guiding belt passing around the shifting roller.

5 Claims, 1 Drawing Figure

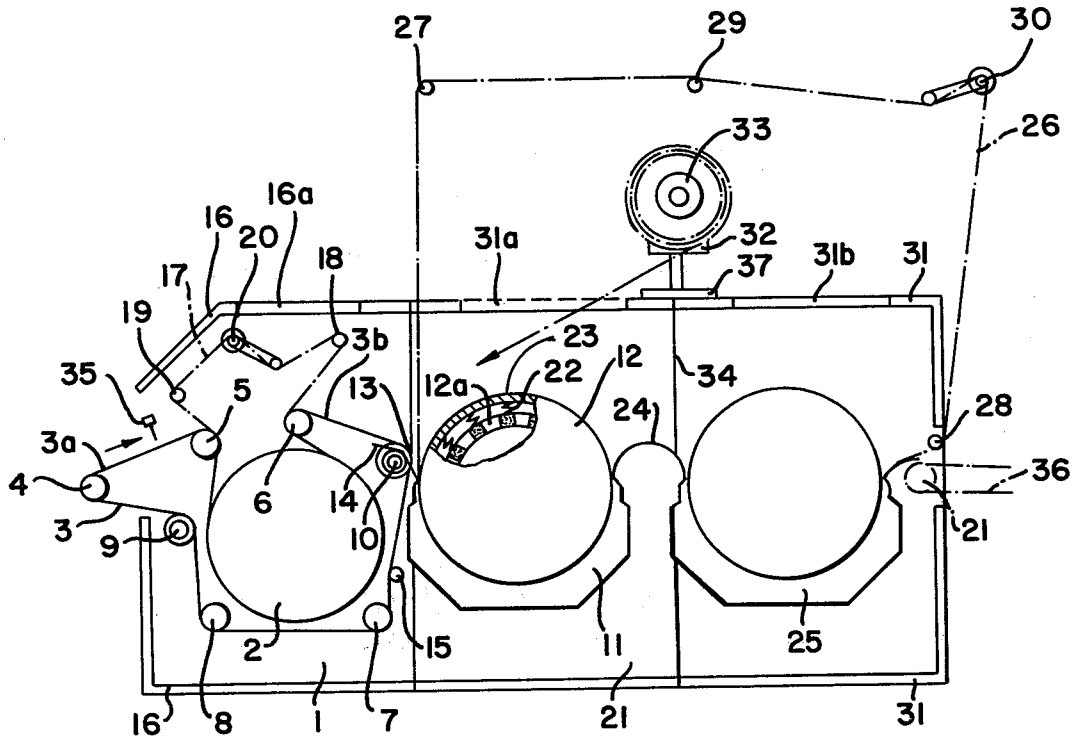
30
26
29
27
33
32
37
31b
31
31a
34
28
36
21
25
24
12
23
22
12a
11
15
13
14
10
7
3b
18
16a
20
16
17
19
35
3a
4
3
9
5
6
2
8
1
16

LAUNDRY MANGLE WITH ROLL COVERING REEL

BACKGROUND OF THE INVENTION

This invention relates to a smoothing and drying apparatus for damp laundry comprising at least one mangle unit that is substantially formed by a mangle trough and a mangle cylinder associated with the mangle trough, and comprising revolving laundry guiding belts that promote the guiding of the laundry through the smoothing and drying zones, and which pass through the smoothing and drying zones and can be substantially adjusted by means of shifting device provided above the mangle cylinder to be redirected to the drying and smoothing zones.

A trough ironing machine (German Pat. No. 534 806, Kl. 8d, 20) is already known, which comprises several mangle troughs and mangle cylinders associated with them, which are lined with a textile coating. For better guiding of the laundry inside the trough ironing machine, especially in the zone of passage from one mangle trough to another one, laundry guiding belts are provided. These endless laundry guiding belts pass through the mangle troughs, being subsequently directed back to the trough inlet by means of a shifting device provided above the mangle cylinders. Herein, the distance between that portion of the laundry guiding belts that returns to the mangle inlet and the mangle cylinders is relatively small. Thereby winding a textile covering around the mangle cylinder or unwinding such covering from the mangle cylinder is possible only when the laundry guiding belts are removed before the winding operation. The need to remove the laundry guiding belts and to place them back after the winding operation into a position of drying and smoothing, however, is very costly and leads to large wear-and-tear of the laundry guiding belts. In addition, in view of the aforementioned steps, the winding operation requires a large amount of time.

SUMMARY OF THE INVENTION

It is the object of the invention to form the smoothing and drying apparatus for damp laundry in such a way that time and expenses involved in unwinding and/or winding the textile covering of a mangle cylinder are minimized, while protecting the laundry guiding belts as much as possible.

The invention has the object of creating an apparatus for smoothing and drying damp laundry in which the unwinding and/or winding of a textile covering around the respective mangle cylinder can be acocomplished in such a way that the portion of the laundry guiding belts that are outside the smoothing and drying zones also remain in position during the winding operation, as during the smoothing and drying operations.

The object of this invention is accomplished in that the apparatus for smoothing and drying damp laundry has at least one mangle trough and at least one mangle cylinder which are arranged inside a frame, revolving laundry guiding belts arranged to guide the laundry in the smoothing and drying zones which pass through these smoothing and drying zones and substantially pass back to the smoothing and drying zones over a shifting device above the mangle cylinder, wherein a winding device is provided between the mangle cylinder and the upper portion of the laundry guiding belt that passes around the shifting devices and passes between these shifting devices.

The winding apparatus is mounted on the frame and is arranged to be laterally displaceable in the direction of the longitudinal axis of the skein and lockable in its position. The winding apparatus is further detachably mounted on the frame, being mounted on this frame in a displaceable, lockable manner. In addition, the winding apparatus has a controlled, movable or brakeable skein.

The textile covering on each mangle cylinder is subject to wear-and-tear so that this textile covering must be changed periodically. This involves, on the one hand, unwinding the textile covering from the mangle cylinder and, on the other hand, winding the mangle cylinder with a new textile covering. On unwinding of the textile covering, the starting edge on the outside of the mangle cylinder is placed on the skein, and is unwound from the mangle cylinder and wound-up on the skein by a drive of the skein. Next, the carrier on which the skein is mounted in bearings, is laterally extended, the skein then being lifted off the carrier. Another skein, around which a new textile coating has been wound, is placed on the carrier that has been laterally extended, namely on the bearings. Then, these carriers and the skein are slid in an axial direction of the skein over two frame walls arranged on both sides of the mangle cylinder and fixed in position. Thereafter, withdrawal of the textile covering that is in a stretched state on the skein and the winding up of this textile covering on the mangle cylinder occurs.

The skein can be driven by suitable means (not represented) when it is wound with the textile covering. This may take place on its winding with a new textile covering and also on withdrawal of the textile covering from the mangle cylinder. The speed of the skein is furthermore controlled by a braking means which is especially needed on winding of the mangle cylinder, in order to maintain pre-tensioning of the textile skein. Through this arrangement of a winding device between the mangle cylinder and the upper portion of the laundry guiding belts passing around the shifting device and the formation of the winding device, it is possible for the laundry guiding belts to maintain their position during drying and smoothing of the laundry, and during the winding operation (unwinding of the textile covering from the mangle cylinder and/or winding of the textile covering on the mangle cylinder). Herein, in addition to protection of the laundry guiding belts during a change of the textile covering, working conditions for the servicing personnel on the unwinding and/or winding of the mangle cylinder with the textile covering are made more favorable.

BRIEF DESCRIPTION OF THE DRAWING

The invention will now be explained in more detail by way of an example of an embodiment. The pertinent drawing illustrates a schematic representation of a smoothing and drying apparatus for damp laundry.

DESCRIPTION OF A PREFERRED EMBODIMENT

As can be seen from the drawing, a heated rotatably mounted, driven cylinder 2 which may, for example, serve as a preheating or else as a pre-drying cylinder, is arranged on a frame 1. This cylinder 2 is almost completely surrounded by several, however at least two, co-travelling belts 3. These co-travelling belts 3 preferbly have a screen-like structure and are, further, guided over the shifting rollers 4, 5, 6, 7 and 8 as well as over guiding rollers 9 and 10. The shifting rollers 4, 5, 6, 7 and 8 and the guiding rollers 9 and 10 are also rotatably mounted on frame 1.

Herein, the guiding of co-travelling belts 3 occurs in such a way that they preferably ascend upwardly, between the shifting rollers 4 and 5 in the direction of the laundry transport (symbolically represented in the drawing by an arrow), thereby forming, at the same time, a favorable contact area 3*a* for depositing the laundry piece. In view of the arrangement of the shifting roller 6, as viewed in a vertical direction, over the central axis of and directly above the outside of the jacket of cylinder 2 and the arrangement of the guiding roller 10 in direct proximity to the inlet wedge 13 formed by the mangle trough 11 and the mangle cylinder 12, the co-travelling belts 3 form a transfer zone 3*b*. In this transfer zone 3*b*, the laundry piece rests freely on the co-travelling belts 3. This, in addition to a favorable guiding of the co-travelling belts 3 and the concomitantly related favorable transport of the laundry piece, results in additional drying or pre-drying of the laundry piece in view of the temperature prevailing inside the apparatus for drying or predrying. Transfer bars 14 are preferably arranged between co-travelling belts 3, under the side of the co-travelling belts 3 carrying the laundry piece, in the zone of guiding roller 10. These transfer bars 14 protrude as far as possible into intake wedge 13 and make it is possible to safely guide the laundry piece to the mangle trough 11. In order to appropriately stretch the co-travelling belts 3 and maintain them, for example, at a predetermined tension, a tensioning device 15 is provided in the zone where the co-travelling belts 3 do not transport the laundry piece. In the drawing, this tensioning device 15 is preferably represented as a tensioning roller arranged in the zone of the co-travelling belts 3 between the guiding roller 10 and the shifting roller 7. This tensioning device 15 can be shifted in its position in relation to the co-travelling belts 3 so that the contact pressure of the co-travelling belts 3 onto cylinder 2 is preferably controllably adjusted. Another possibility of formation of the tensioning device 15 is that each co-travelling belt 3 can be separately tensioned by a tension roller.

To safely guide the laundry piece, especially in the zones from the shifting roller 5 to cylinder 2 and from cylinder 2 to the shifting roller 6, additional laundry guiding belts 17 are provided, preferably within the thermally insulated covering 16, said additional belts 17 guided over the shifting rollers 5, 6, 18 and 19 and over cylinder 2. A tensioning device 20 is preferably arranged between the shifting roller 18 and the shifting roller 19. Each laundry guiding belt 17 can be stretched separately by means of this tensioning device 20. Herein, the laundry guiding belts 17 are preferably arranged in such a way that, in each case, at least one laundry guiding belt 17 will lie on a co-travelling belt 3 and a laundry guiding belt 17 will always lie in the division of the co-travelling belts 3. If several laundry guiding belts 17 are used to rest on the co-travelling belt 3, then the distance of all laundry guiding belts 17 arranged over the entire width of cylinder 2 is preferably the same.

Movement of the co-travelling belts 3 and laundry guiding belts 17 required for transporting the laundry piece occurs, in the present case, by rotational movement of the driven cylinder 2.

As can be further seen in the drawing, a two-trough mangle is arranged after the aforedescribed pre-heating or pre-drying unit. However, it is also possible to subsequently arrange only one or more than two trough mangle units since the trough mangle units are formed of a modular design.

The first trough mangle unit substantially comprises a heated mangle trough 11 and a perforated mangle cylinder 12, around which an air-permeable, preferably elastic covering has been wound. The mangle cylinder 12 as well as the mangle trough 11 are mounted in frame 21. The air-permeable, preferably elastic covering of the mangle cylinder 12 substantially comprises a spring bellows 22 provided on perforated jacket 12*a* and a textile covering 23 provided on spring bellows 22. The contact pressure required for smoothing and further drying the laundry can be achieved and set by non-illustrated means, such as pneumatic cylinders. Herein, mangle cylinder 12 is preferably pressed into mangle trough 11. Herein, the drive of the mangle cylinder 12 is designed in such a way that the circumferential velocity is slightly higher than that of cylinder 2. The circumferential velocity of the mangle cylinder following the mangle cylinder 12 is also slightly greater in relation to mangle cylinder 12.

In addition, each mangle cylinder is connected to a non-illustrated suctioning device in order to suction off the steam that forms on drying the laundry.

For transferring the laundry piece from the first to the second trough mangle unit, a heated trough bridge 24 is arranged at the exit of mangle trough 11, and is also connected to the inlet of the following mangle trough 25.

Since the trough mangle units are designed according to the unit-construction principle of the modular mode of construction, it is refrained from describing the other trough mangle units here, as such construction is substantially similar to the first trough mangle unit.

In order to safely guide the laundry piece in the trough mangle units, especially in the zone of trough bridge 23, laundry guiding belts 26 have been provided, which are guided over the rollers 27, 28 and 29 in the zone of the ironing surface of the mangle troughs 11, around mangle cylinder 12 and between the mangle cylinders over trough bridge 24. Each laundry guiding belt 26 can be separately stretched by means of the tensioning device 30. The laundry guiding belts 26 may be completely arranged inside or partly outside the thermally insulated covering 31.

Transport of the laundry guiding belts 26 occurs through a rotational movement of mangle cylinder 12, or of the mangle cylinders in the case of several trough mangle units. In order to prevent thermal energy losses as much as possible, this apparatus for smoothing and drying damp laundry has thermally insulated coverings 16 and 31. These coverings 16 and 31 have removable elements 16*a*, 31*a* and 31*b*, preferably in the skein area. Furthermore, bearing 32 for receiving a skein 33 is arranged on frame 21. Bearings 32 are arranged herein in such a way that, together with skein 33, they are located between the guiding belts 26. In addition, bearings 32, including skein 33, are appropriately arranged to be displaceable and lockable in the direction of the central axis of skein 33. Furthermore, bearings 32 are conveniently arranged over the junction point 34 of the adjoining mangle units. In addition, the apparatus for drying and smoothing damp laundry is provided at the laundry inlet, namely in the contact area 3*a*, with a protection device that becomes activated on operation of the entire apparatus. In the event of the apparatus for drying and smoothing being switched off, another switch-controlled preferably an electromagnetic, brake acts on cylinder 2. The conveying means 36 of a folding machine may, for example, be arranged at the outlet of the last trough mangle unit of the apparatus for drying and smoothing laundry.

The textile covering 23 on mangle cylinder 12 is subject to wear-and-tear so that this textile covering 23 has to be changed periodically. The winding of the mangle cylinder will now be described by means of an example of a winding of mangle cylinder 12 of the first trough mangle unit.

After element 31*a* of covering 31 has been removed, the textile covering 23 on mangle cylinder 12 can be removed. On the laterally-extended carrier with the bearings 32, skein 33 with the intended new textile covering 23 is placed. Next, this carrier 37, including the bearings 32 and skein 33, is slid over the walls of frame 21 arranged on both sides of mangle cylinder 12 and locked. Then the withdrawal of the textile covering 23, which is in a stretched condition on skein 33, is effected, followed by the winding up of this textile covering onto mangle cylinder 12.

The distance, viewed in the vertical direction, between the skein of covering 31 and the rollers 27 and 28 and the tensioning device 30 is selected in such a way that this distance is greater than the height of carrier 37, including the wound skein 33 that rests on bearings 32. As a result of this distance, the mangle guiding belts remain in position on the ironing of laundry. In an analogous manner, as described above, winding of the next mangle cylinder is accomplished. Skein 33, on being wound with the textile covering 23, is drivable by appropriate means that have not been represented. This may occur on winding with a new textile covering 23 as also on withdrawal of the textile covering 23 from mangle cylinder 12. Furthermore, skein 33 can be braked through appropriate means, not illustrated, which is especially required on the winding of the mangle cylinder 12, in order to maintain a pre-tension in textile covering 23.

The advantages of the solution of this invention are especially an exchange of the textile covering 23 on mangle cylinder 12 without removing the mangle guiding belts 26 from the path which they follow on the ironing of the laundry piece. This results in as much protection as possible of the laundry guiding belts 26 during the exchange of the textile covering 23 and more favorable working conditions for the servicing personnel on winding mangle cylinder 12.

We claim:

1. A smoothing and drying apparatus for damp laundry, comprising (A) at least one mangle cylinder and corresponding mangle trough, (B) a frame on which said mangle cylinder and trough (A) are arranged, (C) at least one revolving laundry guiding belt extending around said mangle cylinder (A) for guiding laundry through said apparatus for smoothing and drying, (D) at least one shifting device around which said revolving laundry guiding belt passes, for directing said laundry guiding belt back to receive more laundry and guide said laundry to be smoothed and dried, and (E) a covering adapted to be wound around said mangle cylinder, wherein the improvement comprises (F) a device for winding and unwinding said covering around said cylinder, said device (F) positioned above said mangle cylinder (A) and below a portion of said revolving laundry guiding belt (C) passing around said shifting device (D).

2. The apparatus of claim 1 in which said winding device (F) is mounted on said frame (B).

3. The apparatus of claims 1 or 2 in which said winding device (F) comprises (G) a skein about which said covering (E) is wound before or after being wound around said mangle cylinder (A), said skein disposed on said device to be removed from or inserted in said device from a substantially lateral direction between said mangle cylinder (A) and said portion of the guiding belt (C) passing around said shifting device (D), and said skein adapted to being secured on said device (F).

4. The apparatus of claims 1 or 2 in which the device (F) is adapted to be affixed to or detached from said frame (B).

5. The apparatus of claim 10 in which the device (F) is adapted to being displaced along said frame (B) to change coverings on a plurality of mangle cylinders (A).

* * * * *